US007004135B2

(12) United States Patent
Tsutsumi et al.

(10) Patent No.: US 7,004,135 B2
(45) Date of Patent: Feb. 28, 2006

(54) ENGINE STARTER UNIT

(75) Inventors: Koichi Tsutsumi, Wako (JP); Hidetoshi Takamatsu, Wako (JP); Ryuichi Abe, Wako (JP); Hiroyuki Sugiura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/854,454

(22) Filed: May 26, 2004

(65) Prior Publication Data

US 2004/0255890 A1 Dec. 23, 2004

(30) Foreign Application Priority Data

Jun. 23, 2003 (JP) ..... 2003-177573

(51) Int. Cl.
*F02N 11/00* (2006.01)

(52) U.S. Cl. ..... 123/179.24; 74/7 C

(58) Field of Classification Search ..... 123/179.24; 74/6, 7 C, 7 E

See application file for complete search history.

(56) References Cited

U.S. PATENT DOCUMENTS 5,038,731 A * 8/1991 Shimada ..... 123/192.2
5,065,644 A * 11/1991 Shimada ..... 74/603
5,626,111 A * 5/1997 Kawakubo et al. .... 123/179.24

FOREIGN PATENT DOCUMENTS

JP 2002-54540 2/2002
JP 2002-122290 4/2002

* cited by examiner

*Primary Examiner*—Andrew M. Dolinar
(74) *Attorney, Agent, or Firm*—Hamre, Schumann, Mueller & Larson, P.C.

(57) ABSTRACT

In an engine starting unit, a gear switching clutch is fitted on one end of a main shaft, a power transmission gear train including a clutch gear rotating together with an input member of the gear switching clutch is provided between one end of a crankshaft and the input member, a kick start gear train is arranged between a drive gear group and the clutch gear, and a one-way starter clutch is arranged on the crankshaft between the drive gear group and the clutch gear.

5 Claims, 7 Drawing Sheets

ENGINE STARTER UNIT

FIELD OF THE INVENTION

The present invention relates to a starter unit for an engine comprising a crankshaft rotatably supported in a crank case, a main shaft rotatably supported in the crank case parallel to the crankshaft and fitted with drive gear groups of a plurality of gear stages, a gear shifting clutch for switching between engagement and disengagement of drive between the crankshaft and the main shaft, and a one way starter clutch interposed between a starter motor and the crankshaft.

BACKGROUND OF THE INVENTION

A starter unit for an engine comprising a gear shifting clutch fitted to a main shaft of a transmission, and a one-way starter clutch interposed between a clutch gear rotating together with an input member of the gear shifting clutch and a free-wheel gear rotating around an axis of a main shaft in response to power transmission from a starter motor, are well known. For example, refer to Japanese Patent No. 2002-54540.

On the other hand, a starter unit that inputs starting operation force in response to a kick operation to a main shaft is also known, for example from Japanese Patent No. 2002-122290, and it is also possible to start an engine with a kick operation in addition to starting the engine using a starter motor.

However, with a structure where the one-way starter clutch is arranged coaxially with the main shaft, as described above, a power transmission load imposed by the one-way starter clutch is comparatively large, and with the one-way starter clutch being made large in size, there is a possibility of encouraging increase in size of the engine.

Also, in the case where it is also possible to start an engine using a kick operation, if the one-way starter clutch is arranged coaxially with the main shaft, a space for the kick start gear train to engage with the main shaft side must be ensured at a position lined up in a direction coaxial with the one-way starter clutch, making the engine extremely large in size.

The present invention has been conceived in view of the above described situation, and an object of the invention is to provide a an engine starter unit that reduces the load on a one-way starter clutch as well as effectively ensuring a space for arranging a kick start gear train, and that is capable of making an engine small in size.

SUMMARY OF THE INVENTION

In order to achieve the above described object, a starter unit for an engine comprising a crankshaft rotatably supported in a crank case, a main shaft rotatably supported in the crank case parallel to the crankshaft and fitted with drive gear groups of a plurality of gear stages, a gear shifting clutch for switching between engagement and disengagement of drive between the crankshaft and the main shaft, and a one way starter clutch interposed between a starter motor and the crankshaft, wherein the gear shifting clutch is fitted on one end of the main shaft, a power transmission gear train including a clutch gear rotating together with an input member of the gear shifting clutch is provided between one end of the crankshaft and the input member, a kick start gear train capable of inputting starting operation force in response to a kick operation to the clutch gear, is arranged between the drive gear group and the clutch gear running along the axial direction of the main shaft, and the one-way starter clutch arranged between the drive gear group and the clutch gear running along the axial direction of the main shaft, is fitted on the crankshaft.

According to this structure, since the one-way starter clutch is fitted on the crankshaft, a power transmission load imposed by the one-way starter clutch is made comparatively small and it is possible to make the one-way starter clutch small, and reduce to size of the engine. Also, since the one-way starter clutch and the kick start gear train are arranged between a drive gear group and the clutch gear in the axial direction of the main shaft, in addition to starting the engine using the starter motor it is also possible to start the engine using a kick operation. So, it is possible for a kick start gear train to be efficiently arranged in a space between the drive gear group and the clutch gear created by arranging the one-way starter clutch. It is also possible to avoid making the engine large because of arrangement of the kick start gear train.

Also, the invention may be characterized by the fact that a first drive gear constituting part of the power transmission gear train is fixed to one end of the crankshaft projecting from the crankcase with a bearing interposed between the crankcase and the crankshaft, and the one way starter clutch and a second drive gear fixed to the crankshaft and constituting part of an auxiliary drive transmission gear train are arranged parallel to each other between the first drive gear and the bearing. According to this structure, effective use is made of the space for arranging the kick start gear train, making it possible to arrange an auxiliary drive power transmission gear train and contributing to reduction in engine size.

In addition to the structure of inventions described above, the one way starter clutch may be provided with a clutch inner input with drive force from the starter motor, and a clutch outer fitted to the crankshaft incapable of relative rotation, and having an inner boss section supported on the clutch inner capable of relative rotation, and the inner boss section is fitted between the first drive gear and the second drive gear. According to this structure, backlash of the one-way starter clutch in a direction along the axis of the crankshaft can be suppressed without using dedicated components. It is possible to avoid significant increase in the number of components and to improve durability of the one-way starter clutch and to reduce noise.

Also, in addition to the structure of the inventions described above, the starter unit may be characterized by the fact that the first drive gear, the inner boss section of the clutch outer, and the second drive gear are in mutual contact and fitted on the crankshaft incapable of relative rotation, a tube section contacting an outer surface of an inner race of the bearing arranged further inwards in an axial inner direction than the second drive gear is integrally provided in an extended manner on the second drive gear, and a bolt having a spread diameter head contacting and engaging with an outer end of the first drive gear is coaxially screwed into one end of the crankshaft. With this structure, the first drive gear, clutch outer and second drive gear are fixed to a crankshaft having a simple or multipart structure without the need for components other than bolts. Also, it is possible to prevent inclination of the first drive gear, clutch outer and second drive gear with respect to the axis of the crankshaft, and to improve durability of the one-way starter clutch and to significantly reduce noise.

DETAILED DESCRIPTION OF THE INVENTION

Embodiments of the present invention will now be described below based on the attached drawings.

Figure 1:
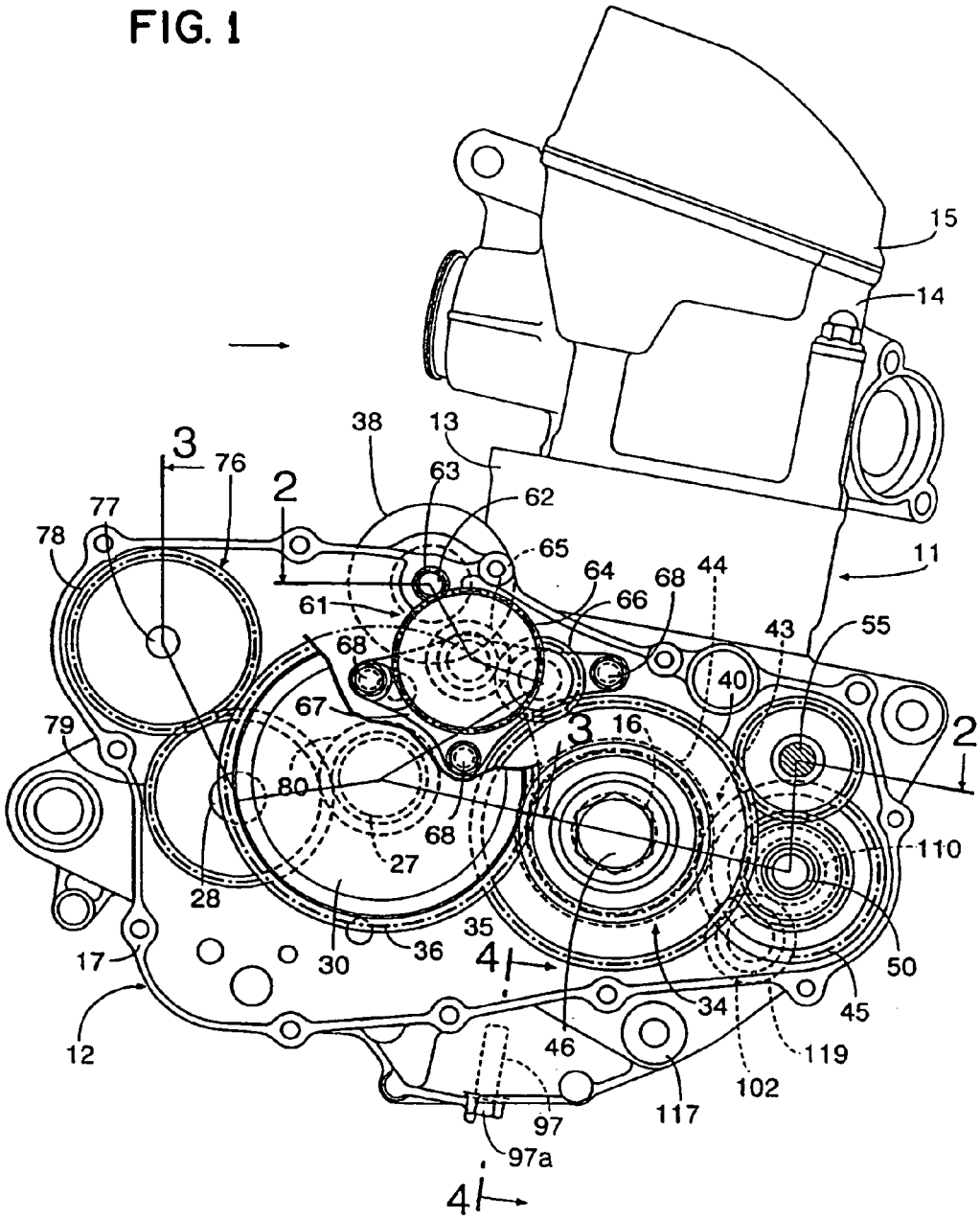
FIG. 1 is a vertical cross-sectional drawing of an engine, along line 1—1 in FIG. 2.
Figure 2:
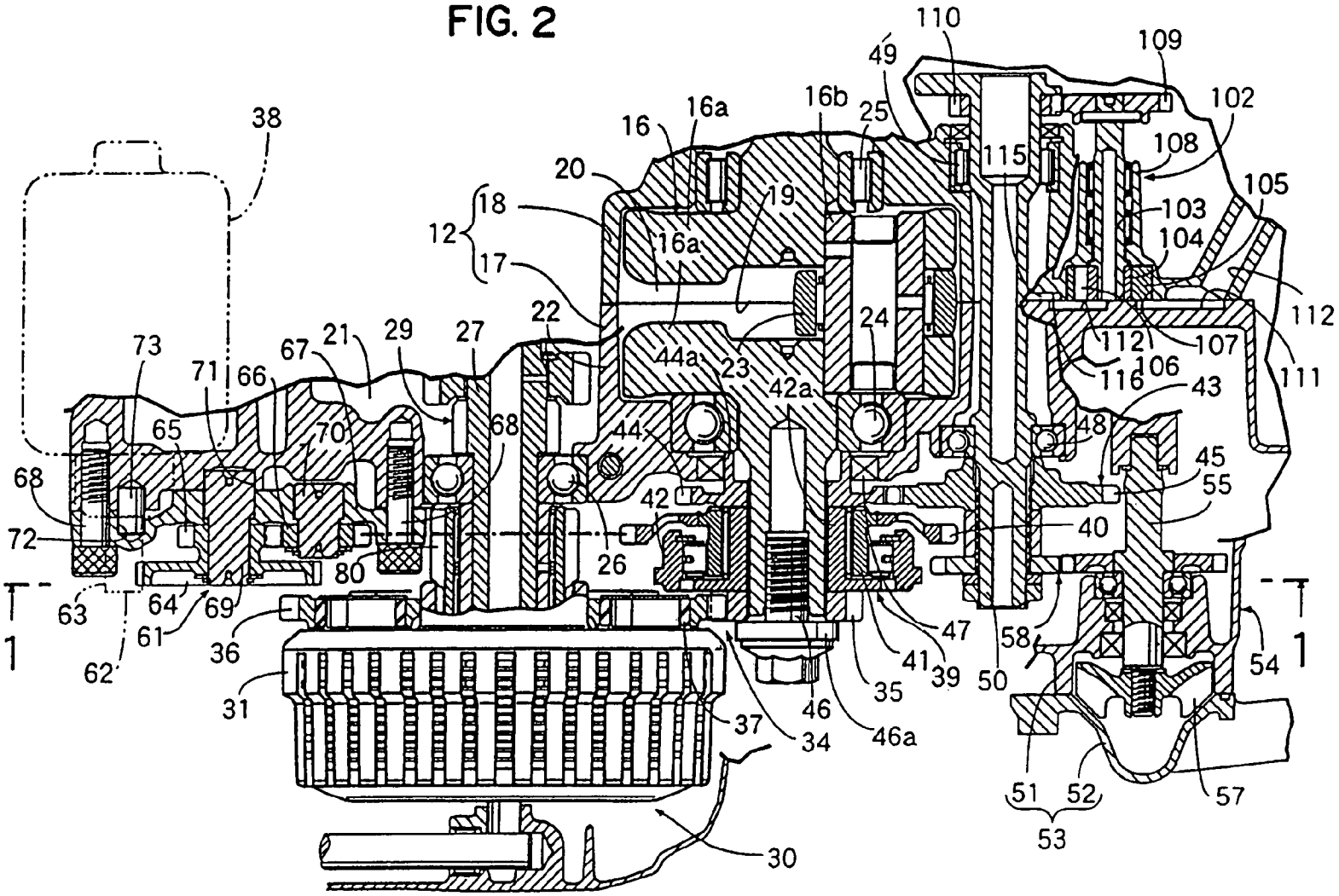
FIG. 2 is a cross sectional drawing along line 2—2 in FIG. 1.
Figure 3:
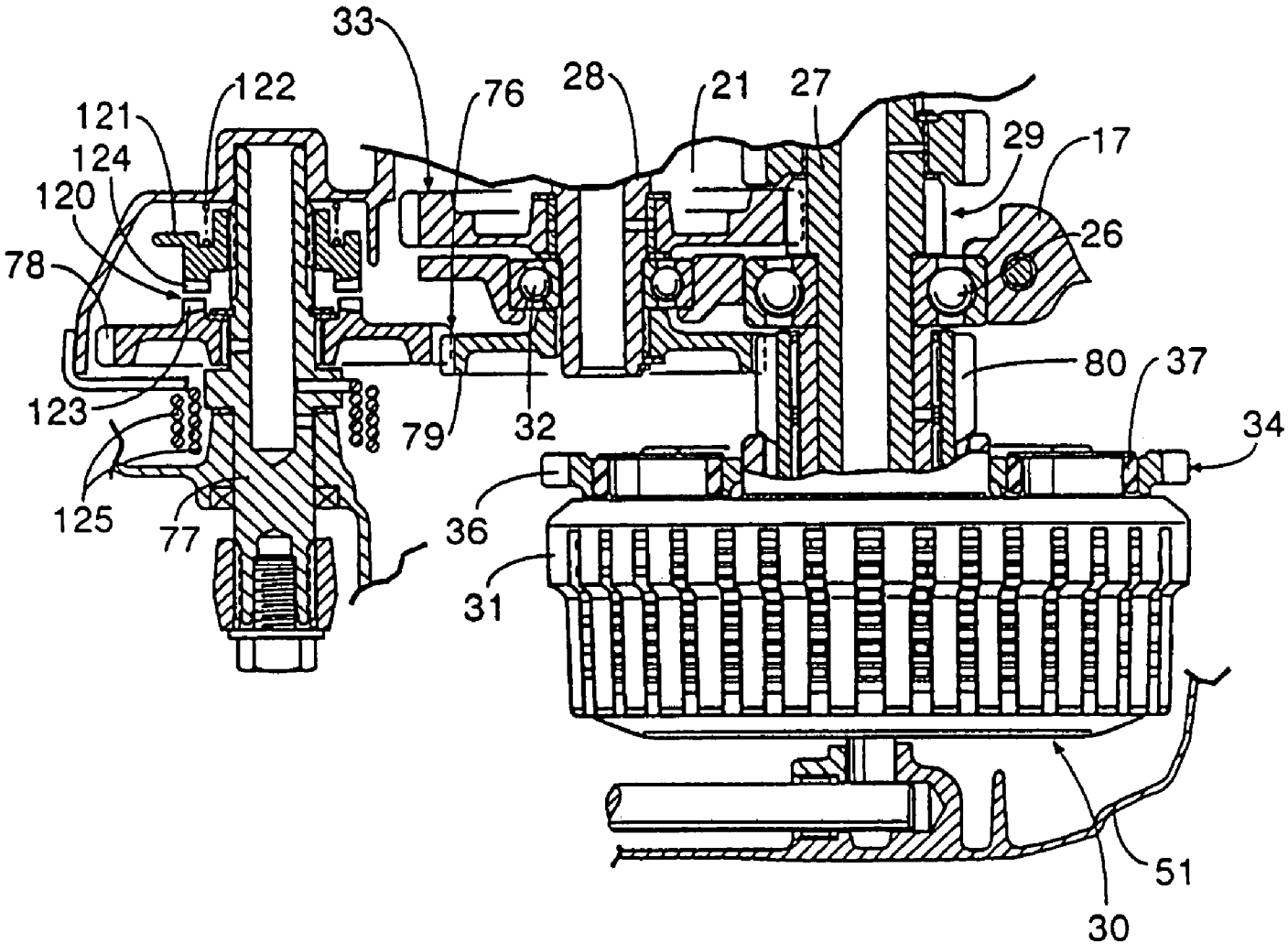
FIG. 3 is a cross sectional drawing along line 3—3 in FIG. 1.
Figure 4:
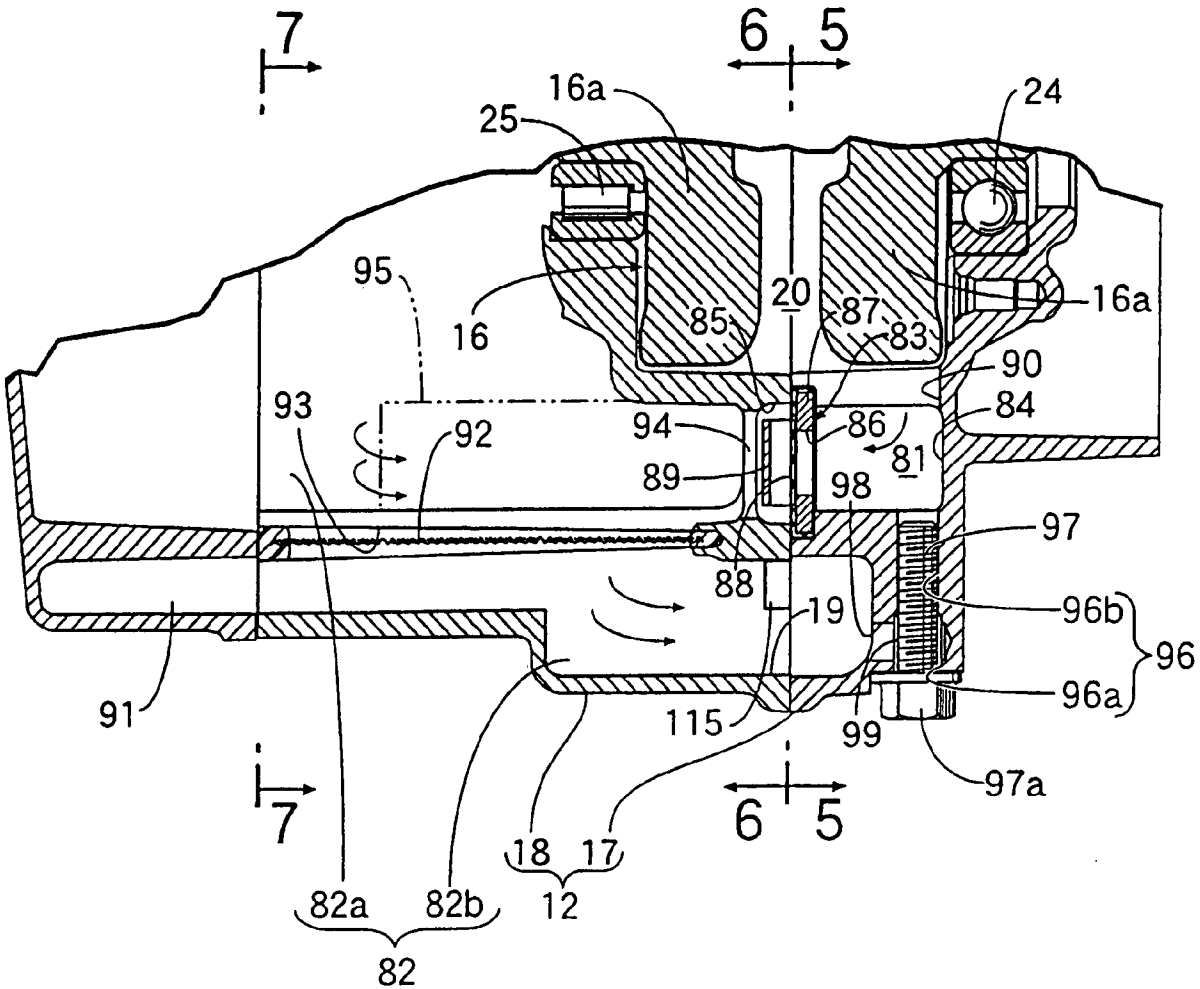
FIG. 4 is a cross sectional drawing along line 4—4 in FIG. 1.
Figure 5:
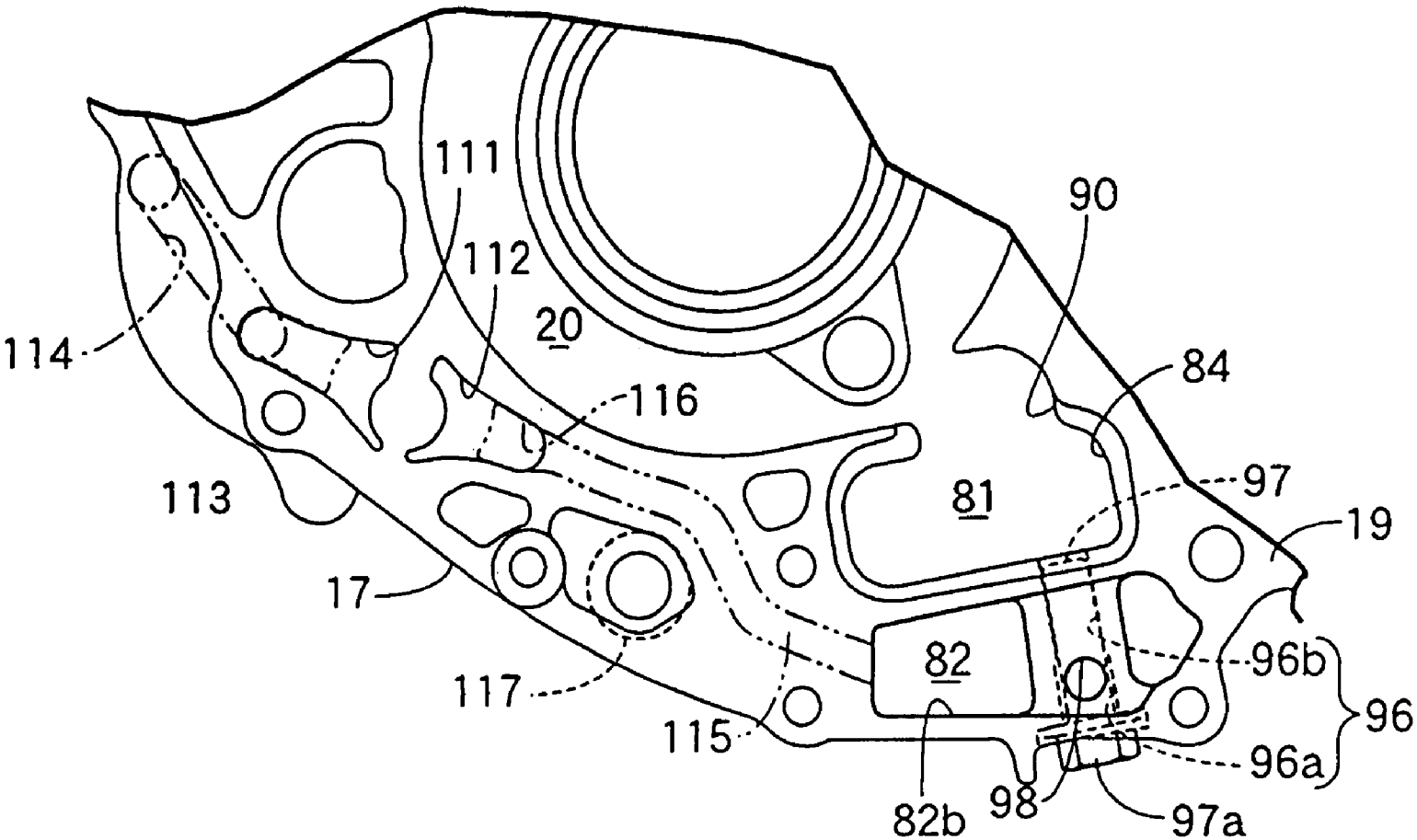
FIG. 5 is a drawing of a right case half body looking from the direction of arrows 5—5 in FIG. 4.
Figure 6:
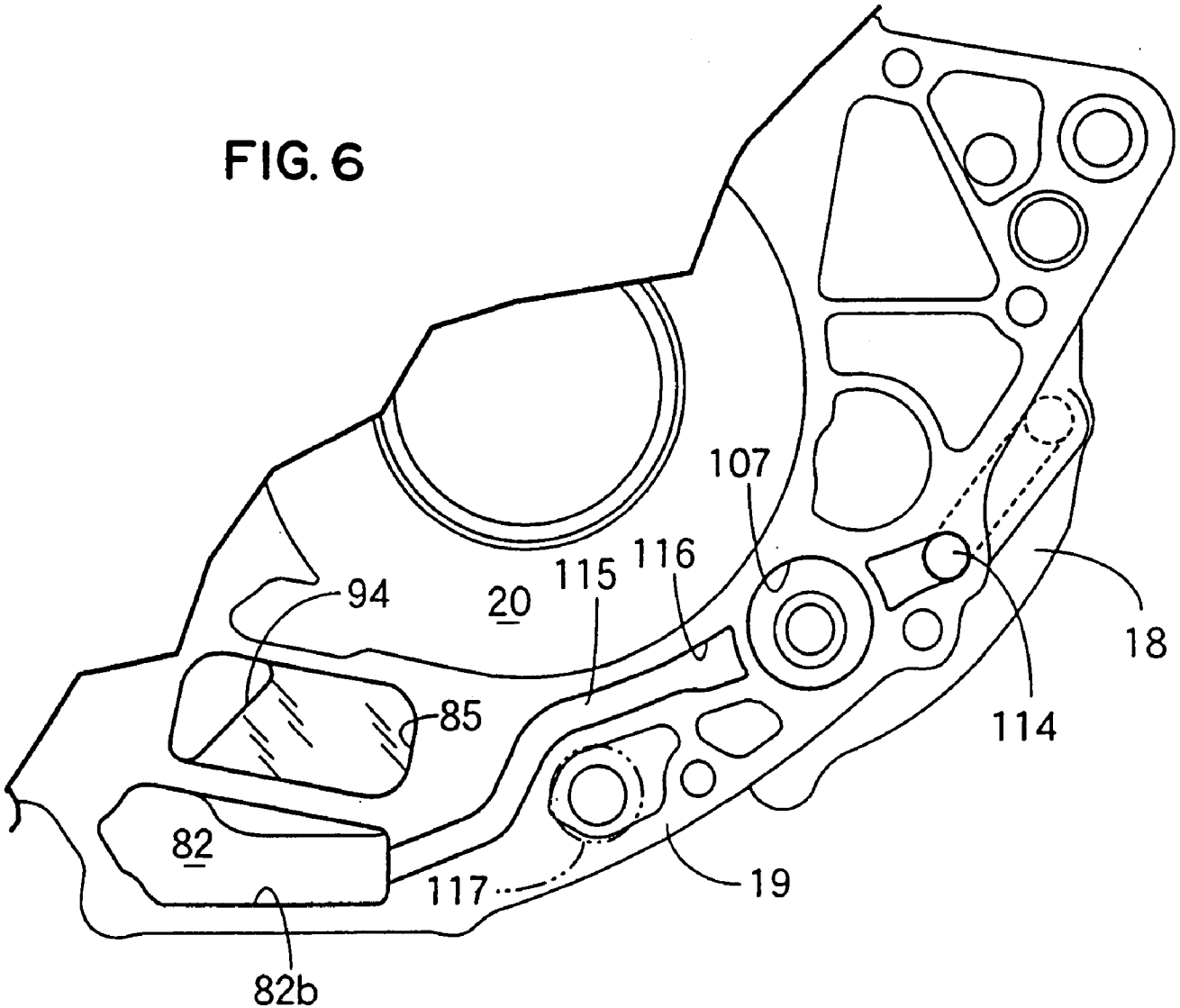
FIG. 6 is a drawing of a left case half body looking from the direction of arrows 6—6 in FIG. 4.
Figure 7:
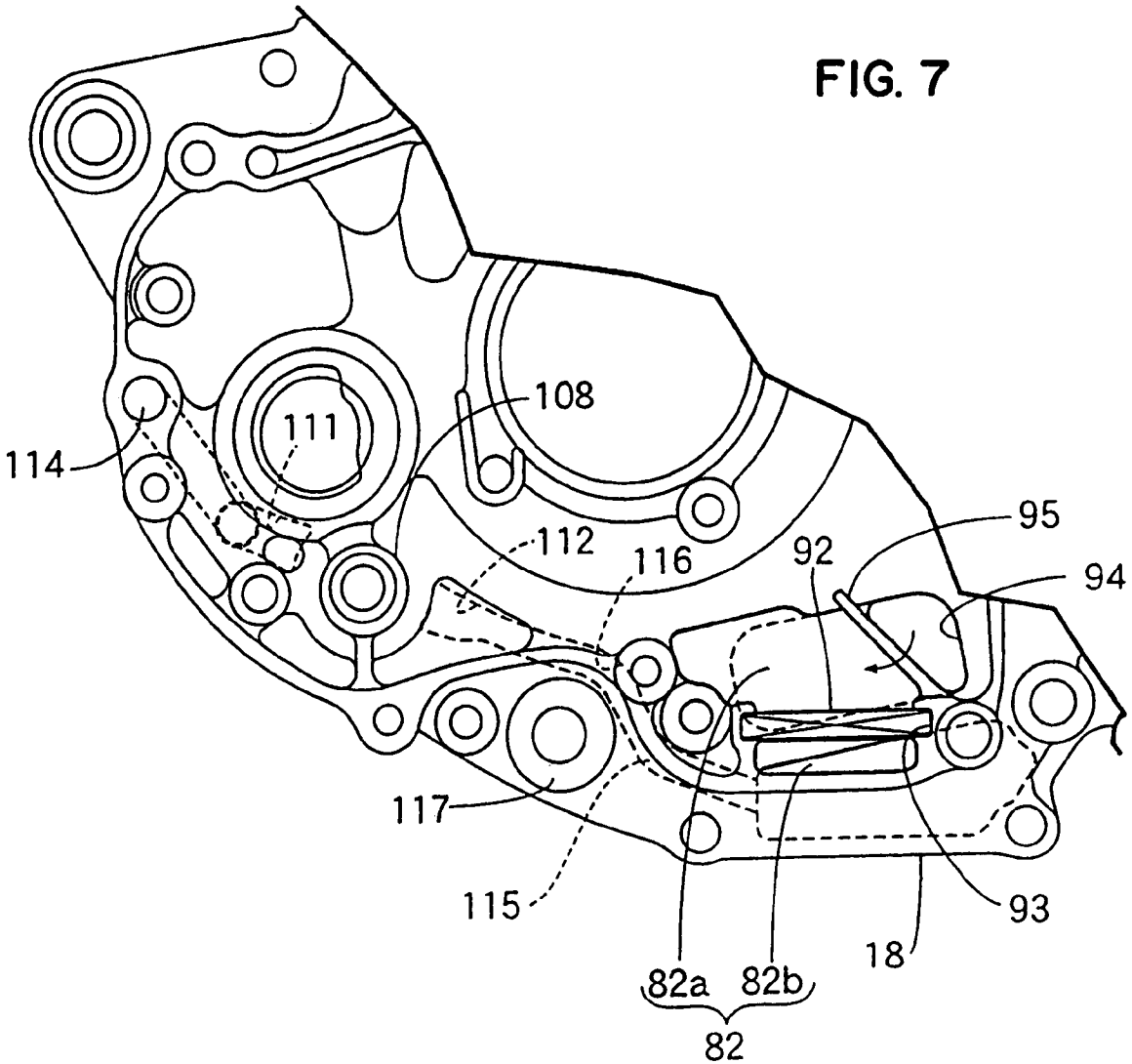
FIG. 7 is a drawing of a left case half body looking from the direction of arrows 7—7 in FIG. 4.

FIG. 1 to FIG. 7 show one embodiment of the present invention, wherein FIG. 1 is a vertical cross section of an engine, along line 1—1 in FIG. 2, FIG. 2 is a cross section along line 2—2 in FIG. 1, FIG. 3 is a cross section along line 3—3 in FIG. 1, FIG. 4 is a cross section along line 4—4 in FIG. 1, FIG. 5 is a drawing of a right case half body looking from the direction of arrows 5—5 in FIG. 4, FIG. 6 is a drawing of a left case half body looking from the direction of arrows 6—6 in FIG. 4, and FIG. 7 is a drawing of a left case half body looking from the direction of arrows 7—7 in FIG. 4.

First of all, in FIG. 1, this engine is a single cylinder 4-cycle engine mounted on a vehicle such as a motorcycle, and an engine body 11 comprises a crank case 12, a cylinder block 13 joined to the crank case 12, a cylinder head 14 joined to the cylinder block 13, and a head cover 15 joined to the cylinder head 14.

With reference to FIG. 2, a crankcase 12 supporting a crankshaft 16 in a freely rotatable manner is made up of a right case half body 17 arranged on a right side when mounting on a motorcycle, and a left half case body 18 arranged on a left side when mounting on the motorcycle, joined together at a joint surface 19 along a horizontal surface orthogonal to the axis direction of the crankshaft 16, and the two case half bodies 17 and 18 are made of an aluminum alloy. Also, a crank chamber 20, housing main parts of the crankshaft 16, and a transmission chamber 21 housing a continuous mesh type transmission, are formed inside the crankcase 12 so as to be separated from each other by a partition 22.

Main parts of a crankshaft 16, provided with a pair of crank webs 16*a*, 16*a* and a crank pin 16*b* for connecting between the two crank webs 16*a*, 16*a*, are housed inside the crank chamber 20, and the big end of a connecting rod 23 connected to a piston (not shown) slidably fitted in the cylinder block 13 is connected to the crank pin 16*b*.

One end of the crankshaft 16 passes through the right case half body 17 in a rotatable manner, and the other end of the crankshaft 16 passes through the left case half body 18 in a rotatable manner. A ball bearing 24 is interposed between the right case half body 17 and the crankshaft 16, while a roller bearing 25 is interposed between the left case half body 18 and the crankshaft 16.

Referring to FIG. 3, the transmission is comprised of a main shaft 27 rotatably supported in the left and right case half bodies 17, 18 by respective ball bearings 26 so as to be axially parallel to the crankshaft 16, and a counter shaft 28 rotatably supported in the left and right case half bodies 17, 18 by respective ball bearings 32 so as to be axially parallel to the main shaft 27, with drive gear groups 29 for a plurality of gear stages fitted to the main shaft 27, and a driven gear group 33 corresponding to the drive gears 29 fitted to the counter shaft 28. Engine output is passed through the plurality of gear stages and transmitted to the counter shaft 28 by selective establishment of respectively corresponding gears among the drive gear group 29 and the driven gear group 33.

A gear switching clutch 30 for shifting between engaging and disengaging drive between the crankshaft 16 and the main shaft 27 is fitted to one end of the main shaft 27 projecting from the right case half body 17, and an input member 31 provided in the gear switching clutch 30 is supported on the main shaft 27 so as to rotate with respect to the main shaft 27.

A power transmission gear train 34 is provided between the input member 31 of the gear switching clutch 30 and the crankshaft 16, the power transmission gear train 34 being comprised of a first drive gear 35 fixed to one end of the crankshaft 16 and a clutch gear 36 meshing with the first drive gear 3. The clutch gear 36 connects through a damper 37 to the input member 31, and rotates together with the input member 31.

Also, a starter motor 38 having a rotational axis parallel to the main shaft 27 is attached to the right case half body 17 above the main shaft 27, and a one-way starter clutch 39 interposed between the starter motor 38 and the crankshaft 16 is arranged between the drive gear group 29 and the clutch gear 36, running along an axial direction of the main shaft 27, and is fitted on one end of the crankshaft 16.

This one-way starter clutch 39 comprises a clutch inner 41, to which a free-wheel gear 40 input with drive force from the starter motor 38 is fixed, and a clutch outer 42 having an inner boss section 42*a* fitted to the crankshaft 16 so as to be incapable of relative rotation, and supported in the clutch inner 41 so as to be capable of relative rotation, with the inner boss section 42*a* being sandwiched between the first drive gear 35 and the second drive gear 44 constituting part of the auxiliary drive power transmission gear train 43 and fixed to the crankshaft 16.

The first drive gear 35, inner boss section 42*a* of the clutch outer 42, and the second drive gear 44 are in contact with each other, and fixed to the crankshaft 16 so as to be incapable of relative rotation by spline fitting or the like, with a tubular section 44*a* coming into contact with an inner race outer surface of the ball bearing 24 interposed between the crankshaft 16 and the crank case 12 being integrally provided in an extended manner on the second drive gear 44, axially further inwards than the second drive gear 44, and a bolt 46 having an expanded head section 46 that comes into contact and engages with an outer end of the first drive gear 35 being coaxially screwed into one end of the crankshaft 16.

Specifically, the one-way starter clutch 39 and the second drive gear 44 are arranged parallel to each other between the first drive gear 35 and the ball bearing 24, and an annular oil seal 47 is interposed between the tubular section 44*a* and the right case half body 17.

An auxiliary drive power transmission gear train 43 is provided between the crankshaft 16 and a balancer shaft 50 that is rotatably supported in front of the crankshaft 16 in the right case half body 17 and the left case half body 18 by means of a ball bearing 48 and a roller bearing 49, and is made up of the second drive gear 44 fixed to the crankshaft 16 and the first driven gear 45 meshing with the second drive gear 44 fixed to one end of the balancer shaft 50.

Also, a water pump 54 having a pump housing 53 comprising a right cover 51 joined to the right case half body 17 and a pump cover 52 fastened to an outer surface of the right cover 51 is arranged above the balancer shaft 50, and this water pump 54 is provided with a pump shaft 55, parallel to the balance shaft 50.

The pump shaft 55 passes rotatably and in a fluid-tight manner though the right cover 51 of the pump housing 53, with a moving blade 56 fixed coaxially to one end of the pump shaft 55 projecting into the pump housing 53, while the other end of the pump shaft 55 is rotatably supported by the right case half body 17.

A transmission gear train 58 is provided between one end of the balancer shaft 50 and the pump shaft 55, and drive force transmitted from the crankshaft 16 through the auxiliary drive power transmission gear train 43 to the balancer shaft 50 is transmitted to the pump shaft 55 via transmission gear train 58.

A starting power transmission gear train 61 is provided between the starter motor 38 and one end of the crankshaft 16, and this starting power transmission gear train 61 comprises a third drive gear fixed to an output shaft 62 of the starter motor 38, a reduction gear 64 meshing with the third drive gear 63, a first idle gear 65 that is integral with the reduction gear 64, a second idle gear 66 that meshes with the first idle gear 65, and a free-wheel gear 40 fixed coaxially to the clutch inner 41 of the one-way starter clutch 39 and meshing with a second idle gear 66.

Further, part of the starting power transmission gear train 61 is covered from an outer side by the gear changing clutch 30, and of the gears 63-66 constituting the starting power transmission gear train 61, apart from the free-wheel gear 40 at one end of the crankshaft 16 and the third drive gear 63, a plurality of gears 64, 65 and 66 are supported in a cantilevered fashion in the crankcase 12.

A holder plate 67 made of a steel material is attached to the outer surface of the right case half body 17 of the crank case 12 using a plurality of, for example 3, screw members 68, 68. One end of a plurality of, two with this embodiment, support shafts 69, 70 are fixed to the holder plate 67 by press fitting with a reduction gear 64 and a first idle gear 65 being rotatably supported on the other end of one support shaft 69, while a second idle gear 66 is rotatably supported on the other end of the other support shaft 70.

Also, among the plurality of support shafts 69, 70, one end of the support shaft 69 closest to the third drive gear 63 projects from the holder plate 67 to the crankshaft 12 side, and one end of the support shaft 69 is fitted into a positioning indent 71 provided on the right case half body 17 of the crank case 12. A positioning indent 72 opening to the right case half body 17 is provided in the holder plate 67, and a knock pin 73 implanted in the right case half body 17 is fitted into the positioning indent 72.

It is possible to input starting operation force corresponding to a kick operation to the clutch gear 36 via the kick start gear train 76, the kick start gear train 76 comprising a fourth drive gear 78 fitted to a kick shaft 77 rotatably supported by the crank case 12, a third idle gear 79 fixed to the counter shaft 28 and meshing with the fourth drive gear 78, and a second driven gear 80 supported on the main shaft 27 in a manner capable of relative rotation and meshing with the third idle gear 79, with an input member 31 of the gear switching clutch 30 being fitted to the second driven gear 80 incapable of relative rotation. The kick-start drive gear 76 is arranged between the drive gear group 29 and the clutch gear 36, running along an axial direction of the main shaft 27.

The fourth drive gear 78 is rotatably supported on the kick shaft 77 so as to be incapable of relative movement in the axial direction, and a one-way clutch mechanism 120 is provided between the kick shaft 77 and the fourth drive gear 78 for joining between the kick shaft 77 and the fourth drive gear 78 when the kick shaft 77 rotates normally.

This one-way clutch mechanism 120 is comprised of a clutch body 121 fitted to the kick shaft 77 so as to be capable of relative movement in the axial direction but incapable of relative rotation, and a friction spring 122 supplying friction resistance to rotation of the clutch body 121, with ratchet teeth 123, 124 for transmitting only normal rotation of the clutch body 121, specifically the kick shaft 77, to the fourth drive gear 78 at the time of meshing being formed on opposite sides of the fourth drive gear 78 and the clutch body 121.

Also, kick return springs 125, 125 formed from torsion springs are provided between the right case half body 17 and the kick shaft 77, so as to overlap inside and outside, and the kick shaft 77 is urged to the return side by these kick return springs 125, 125.

In FIG. 4 to FIG. 6, a first oil sump 81 communicating with a lower part of the crank chamber 20, and a second oil sump 82 causing a reed valve 83 opening and closing in response to pressure variations inside the crank chamber 20 to be interposed between the first oil sump 81, are formed at a lower part of the crank case 12.

A right side indent 84 and a left side indent 85 that are opposite each other and enclose a joint surface 19 are provided at a lower part of the right case half body 17 and left case half body 18, and when the right case half body 17 and left case half body 18 are combined, the reed valve 83 is enclosed between open ends of the two indents 84 and 85.

That is, the reed valve 83 is provided with a valve plate 87 having a valve hole 86, a reed 88 attached to the valve plate 87 so as to open and close the valve hole 86, and a support plate 89 attached to the valve plate 87 so as to maintain a valve open position of the reed 88, and the periphery of the valve plate 87 is sandwiched between open ends of the indents 84 and 85 so that the reed 88 and the support plate 89 are arranged at the left side indent 85 side.

The first oil sump 81 is formed at the right case half body 17 side between the right side indent 84 and the reed valve 83, and a connecting hole 90 connecting a lower part of the crank chamber 20 with the first oil sump 81 is provided in the right case half body 17.

Referring to FIG. 7, the second oil sump 82 is made up of an upper oil chamber 82*a* formed between the left case half body 18 and a lower part of a left cover 91 joining to the left case half body 18 from an outer side, and a lower oil chamber 82*b* formed so that the right side case 17, the left side case 18 and the lower part of the left side cover 91 span the joint surface 19, a mounting groove 93 for mounting of a filter 92 is provided in the left case half body 17, separating between the upper oil chamber 82*a* and the lower oil chamber 82*b*, so as to open to the left cover 91 side, and uncoupling of the filter 92 from the mounting groove 93 is prevented by joining the left cover 91 to the left case half body 18.

In the left case half body 18, a blocked up end of the left indent 85 is provided with a guiding hole 94 for guiding oil flowing out from the first oil sump 81 as a result of opening of the reed valve 83 to the upper oil chamber 82*a* side of the second oil sump 82. Also, a guide wall 95 is provided in the left case half body 18 to guide oil from the guide hole 94 so as to flow to the left side cover 91, to filter oil discharged from the guide hole 94 to the upper oil chamber 82*a* side using substantially the entire surface of the filter 92.

The lowest part of the lower oil chamber 82*b* of the second oil sump 82 is arranged below the first oil sump 81, and a drain hole 96 extending vertically and with an upper end opened to a bottom section of the first oil sump 81 is provided in the right case half body 17 so as to allow a middle section to be opened to the lowest part of the lower oil chamber 82*b*, and allow a lower end to open to a bottom surface of the right case half body 17 of the crank case 12.

A drain bolt 97 inserted into the drain hole 96 is screwed into the right case half body 17 from below the crankcase 12, and the drain bolt 97 blocks between the first oil sump 81 and the lowermost part of the lower oil chamber 82*b*, as well as blocking the second oil sump 82 from the outside of the crankcase 12.

The drain hole 96 is made up of an insertion hole section 96*a* having a lower end opening to a bottom surface of the right case half body 17, and a screw hole section 96*b* formed in a smaller diameter than the insertion hole section 96*a* coaxially with the insertion hole section 96*a*, and having an upper end opening to the first oil sump 81, a connecting hole 98 having one end communicating with the lowermost section of the lower oil chamber 82*a* of the second oil sump 82 and the other end opening to a middle section inner surface of the insertion hole 96*a* is provided in the right case half body 17, and a drain bolt 97, forming an annular chamber 99 communicating with the communicating hole 98 between the inner surface of the insertion hole 96*a*, has an expanded head section 97*a* that touches and engages with a bottom part of the right case half body 17 of the crank case 12, and is screwed into the screw hole 96*b*.

Oil accumulating in the lowermost part of the second oil sump 82 is sucked up by an oil pump 102, and this oil pump 102 is arranged on the crankcase 22 so that in a state with the engine mounted on the vehicle, it is further forward than the crankshaft 16.

The oil pump 102 has an inner rotor 104 fixed to the inner end of the pump shaft 103, and an outer rotor 105 meshing with the inner rotor 104, and has a trochoid structure.

A pump chamber 106 housing the inner rotor 104 and the outer rotor 105 is formed using a housing indent 107 provided in the left case half body 18 facing the joint surface 19, and the right case half body 17 so that the joint surface 19 is sandwiched between the right case half body 17 and the left case half body 18.

The pump shaft 103 is supported in a fluid tight and rotatable manner by a support tubular section 108 provided in the right case half body 18, and a fourth driven gear 109 is fixed to an outer end of the pump shaft 103 projecting from the support tubular section 108. On the other hand, a fifth drive gear 110 is fixed to the other end of the balancer shaft 50, and the pump shaft 103 is driven to rotate as a result of the fifth drive gear 110 meshing with the fourth driven gear 109.

At a section of the right case half body 17 facing the joint surface 19, a delivery side indent 111 communicating with the pump chamber 106 and an inlet side indent 112 communicating with the pump chamber 106 are provided so as to form a bearing section 113 for receiving the inner end of the pump shaft 103 between these two indents 111 and 112.

On the other hand, an oil delivery passage 114 having one end opening to the joint surface 19 so as to communicate with the delivery side indent 111 is provided in the left case half body 18 so as to supply oil to respective lubricating sections of the engine.

Also, an oil intake passage 115 connects between the intake side indent 112 and the lowermost part of the first oil sump 82, and a passage groove 116 forming the oil intake passage 115 between the right and left case half bodies 17 and 18 sandwiching the joint surface 19 is provided in at least one of the two case half bodies 17 and 18, in the left case body 18 in this embodiment.

Also, the oil intake passage 115 is arranged around the crankshaft 16, and is connected to the lowermost part of the second oil sump 82 by a front lower wall section of the lower most part.

In the crank case 12, an engine hanger boss 117 for mounting of the engine in the vehicle is provided below the crankshaft 16, and the oil intake passage 115 is arranged so as to communicate between the crankshaft 16 and the engine hanger boss 117.

Next, operation of this embodiment will be described. The second oil sump 82 spanning the joint surface 19 is formed at a lower part of the crankcase 12 lower down than the crankshaft 16, and the pump chamber 106 for the oil pump 102 for drawing in oil from the lower most part of the second oil sump 82 is formed between the right and left case half bodies 17 and 18 sandwiching the joint surface 19. The oil intake passage 115 connecting between the oil pump 102 and the lowermost part of the second oil sump 82 is formed between the two case half bodies 17 and 18 sandwiching the joint surface 19 using the passage groove 116 provided on at least one of the two case half bodies 17 and 18 (the left case half body 18 in this embodiment).

Specifically, by constructing the crank case 12 by joining the right and left case half bodies 17 and 18 together with the joint surface 19, the oil intake passage 115 guiding oil of the second oil sump 82 to the oil pump 102 is formed, and compared to using an oil pipe, it is possible to reduce the number of components and to improve ease of assembly.

Also, since the oil pump 102 is arranged further forward than the crankshaft 16 in a state mounted on the vehicle, and the oil intake passage 115 arranged around the crankshaft 16 is connected to the second oil sump 82 at a front wall lower section of the lowermost section of the second oil sump 82, it is possible to set the ground clearance comparatively high by arranging the oil intake passage 115 adjacent to the crankshaft 16, and it is possible to make the volume of the second oil sump 82 comparatively large.

Also, in the crank case 12, an engine hanger boss 117 is provided lower down than the crankshaft 16, with the oil intake passage 115 being arranged so as to communicate between the crankshaft 16 and the engine cover hanger 117. Internal pressure of the oil intake passage 115 is low, and the seal width of the oil intake passage 115 at the joint surface 19 can be set low, which means that it is possible to set the engine hanger boss 117 at a comparatively high position, and it is possible to set the ground clearance of the crankcase 12 even higher.

The first oil sump 81 communicating with a lower part of the crank chamber 20, and the second oil sump 82, causing the reed valve 83 that is opened and closed according to pressure variations inside the crank chamber 20 to be interposed between the first oil sump 81 and the crank case 12, are formed in the crankcase 12, but the first and second oil sumps 81 and 82 are formed in the crank case 12 so that a lowermost part of the second oil sump 82 is arranged below the first oil sump 81, the drain hole 96, having an upper end opening to a bottom part of the first oil sump 81 and extending vertically, and is provided at a lower part of the right case half body 17 of the crank case 12 so that a middle section opens to the lowermost section of the second oil sump 82, and the lower end opens to a bottom surface of the crank case 12, and a drain bolt 97 inserted into the drain hole 96 for blocking between lowermost sections of the first oil sump 81 and the second oil sump 82, and also blocking the second oil sump 82 from the outside of the crankcase 12, is screwed into the right case half body 17 from below the crank case 12.

Therefore, by unscrewing the single drain bolt 97 and removing it from the crank case 12, it is possible to discharge oil from the first oil sump 81 and the second oil sump 82 to the outside of the crank case 12 together. By screwing the drain bolt 97 into the right case half body 17 and tightening it up, it is possible to block the first and second oil sumps 81 and 82 from the outside of the crank case 12, which means that with respect to discharging oil from the first and second oil sumps 81 and 82, it is possible to reduce the number of components and to improve maintainability.

The drain hole 96 is made up of an insertion hole section 96*a* having a lower end opening to a bottom surface of the right case half body 17, and a screw hole section 96*b* formed in a smaller diameter than the insertion hole section 96*a* coaxially with the insertion hole section 96*a*, and having an upper end opening to the first oil sump 81. A connecting hole 98 having one end communicating with the lowermost section of the second oil sump 82 and the other end opening to a middle section inner surface of the insertion hole 96*a* is provided in the right case half body 17, and a drain bolt 97, forming an annular chamber 99 communicating with the communicating hole 98 between the inner surface of the insertion hole 96*a*, has an expanded head section 97*a* that touches and engages with a bottom part of the right case half body 18, and is screwed into the screw hole 96*b*.

According to the type of structure for drain hole 96, it is possible to allow communication between the second oil sump 82 and the drain hole 96 at as low a position inside the lowermost section as possible, while keeping the length of a screw hole section 96*a* required to fasten the drain bolt 97 firmly to the crank case 12 comparatively large, it is possible to make the amount of residual oil inside the first oil sump 81 as small as possible, and it is also possible to make the amount of residual oil inside the second oil sump 82 as small as possible.

Also, the main shaft 27 having an axis parallel to the crankshaft 16 rotatably supported in the crankcase 12, and fitted with a plurality of gear stage drive gear groups 29, is rotatably supported in the crank case 12. The gear switching clutch 30 switching between engaging and disengaging drive force between the crankshaft 16 and the main shaft 27 is mounted on one end of the main shaft 27. The power transmission gear train 34, including the clutch gear 36 rotating together with the input member 31 of the gear switching clutch 30, is provided between one end of the crankshaft 16 and the input member 31. The kick start gear train 76 for inputting starting operation force corresponding to a kick operation to the clutch gear 36 is arranged between the drive gear group 29 and the clutch gear 36, running in the axial direction of the main shaft 27. The one-way starter clutch 39 interposed between the starter motor 38 and the crankshaft 16 is arranged between the drive gear group 29 and the clutch gear 36 running in the axial direction of the main shaft 27, and fitted to the crankshaft 16.

According to the above-described structure, by fitting the one-way starter clutch 39 on the crankshaft 16, a power transmission load imposed by the one-way starter clutch 39 is made comparatively small and it is possible to make the one-way starter clutch 39 small, and reduce to size of the engine. Also, by arranging the one-way starter clutch 39 and the kick start gear train 76 between a drive gear group 29 and the clutch gear 36 along the axial direction of the main shaft 27, in addition to starting the engine using the starter motor 38, it is also possible to start the engine using a kick start operation, so it is possible for a kick start gear train 76 to be efficiently arranged in a space between the drive gear group 29 and the clutch gear 36 created by arranging the one-way starter clutch 39, and it is also possible to avoid making the engine large because of arrangement of the kick start gear train 76.

Also, since the first drive gear 35 constituting part of the power transmission gear train 34 is fixed to one end of the crankshaft 16 projecting from the crankcase 12 with a ball bearing 24 interposed between the right case half body 17 of the crankcase 12 and the crankshaft 16, and the one way starter clutch 39 and the second drive gear 44 fixed to the crankshaft 16 and constituting part of an auxiliary drive power transmission gear train 43 are arranged parallel to each other between the first drive gear 35 and the ball bearing 24, effective use is made of the space for arranging the kick start gear train 76, making it possible to arrange the auxiliary drive power transmission gear train 43 and contribute to reduction in engine size.

The one way starter clutch 39 is provided with a clutch inner 41, input with drive force from the starter motor 38, and a clutch outer 42, fitted to the crankshaft 16 incapable of relative rotation, and having an inner boss section 42*a* supported on the clutch inner 41 capable of relative rotation, with the inner boss section 42*a* being fitted between the first drive gear 35 and the second drive gear 44.

Therefore, backlash of the one-way starter clutch 39 in a direction along the axis of the crankshaft 16 can be suppressed without using dedicated components, and it is possible to improve durability of the one-way starter clutch 39 and reduce noise while avoiding significant increase in the number of components.

The first drive gear 35, inner boss section 42*a* of the clutch outer 42, and the second drive gear 44 are in contact with each other, and fixed to the crankshaft 16 so as to be incapable of relative rotation, with a tubular section 44*a* coming into contact with an inner race outer surface of the ball bearing 24 interposed between the crankshaft 16 and the crank case 12 being integrally provided in an extended manner on the second drive gear 44, axially further inwards than the second drive gear 44, and a bolt 46 having an expanded head section 46*a* that touches and engages with an outer end of the first drive gear 35 being coaxially screwed into one end of the crankshaft 16.

Therefore, the first drive gear 35 the clutch outer 42 and the second drive gear 44 are fixed to the crankshaft 16 with a simple structure with few components not requiring parts other than the bolt 46, and also the first drive gear 35, clutch outer 42 and second drive gear 44 are prevented from being inclined with respect to the axis of the crankshaft 16, significantly increasing the durability of the one-way starter clutch 39 and reducing noise.

The starter motor 38 is attached to the right case body 17 of the crank case 12, and part of the starting power transmission gear train 61 provided between this starter motor 39 and one end of the crankshaft 16 is covered from an outer side by the gear changing clutch 30 linked to the crankshaft 16, and of the gears 63, 64, 65, 66 and 40 66 constituting the starting power transmission gear train 61, apart from the free-wheel gear 40 at one end of the crankshaft 16 and the third drive gear 63 fixed to the output shaft of the start motor 38, a plurality of gears 64–66 are supported in a cantilevered fashion in the crankcase 12, which means that it is possible to tether the gear switching clutch 30 to the crank case 12 side in a direction along the axis of the crankshaft 16, and it is possible to make the engine small in the axial direction of the crankshaft 16.

Further, since one end sides of a plurality (in this embodiment 2) of support shafts 69, 70 are fixed to the holder plate 67 attached to the right case half body 17 of the crank case 12, and, of the gears 63–66 and 40 constituting the starting power transmission gear train 61, except for the free wheel gear 40 and the third drive gear 63, a plurality of gear 64–66 are rotatably supported on the other ends of the support shafts 69 and 70, it is possible to attach the holder plate 67 with the plurality of gears 64–66 constituting part of the starting power transmission gear train 61 assembled to the crank case 12, which means that ease of assembly is improved. Also, compared to making the crank case 12 of aluminum alloy, the holder plate 67 is made from a steel material, and the load on the right case half body 17 at the parts supporting the gears 64–66 is reduced, making it possible to make the holder plate 67 comparatively thin.

Further, since one end of the support shaft 69 closest to the third drive gear 63, among the plurality of support shafts 69 and 70, projects from the holder plate 67 to the right case half body 17 side and is fitted into a positioning indent 71 of the right case half body 17, by using the support shaft 69 as a knock pin, it is possible to improve ease of fitting the holder plate 67 to the crank case 12 while reducing the number of components, and since it is possible to increase support rigidity by supporting the support shaft 69 for the reduction gear 64 that has high rotation speed in the crank case 12, it is possible to improve durability and to reduce meshing noise.

An embodiment of the present invention has been described in detail above, but the present invention is not thus limited and various design changes are possible without departing from the scope of the appended claims.

We claim:

1. A starter unit for an engine comprising a crankshaft rotatably supported in a crank case, a main shaft rotatably supported in the crank case parallel to the crankshaft and fitted with drive gear groups of a plurality of gear stages, a gear shifting clutch for switching between engagement and disengagement of drive between the crankshaft and the main shaft, and a one way starter clutch interposed between a starter motor and the crankshaft, wherein the gear shifting clutch is fitted on one end of the main shaft, a power transmission gear train including a clutch gear rotating together with an input member of the gear shifting clutch is provided between one end of the crankshaft and the input member, a kick start gear train capable of inputting starting operation force in response to a kick operation to the clutch gear, is arranged between one of the drive gear groups and the clutch gear running along the axial direction of the main shaft, and the one way starter clutch arranged between said one of the drive gear groups and the clutch gear running along the axial direction of the main shaft, is fitted on the crankshaft.

2. The starter unit for an engine as disclosed in claim 1, wherein a first drive gear constituting part of the power transmission gear train is fixed to one end of the crankshaft projecting from the crankcase with a bearing interposed between the crankcase and the crankshaft, and the one way starter clutch and a second drive gear fixed to the crankshaft and constituting part of an auxiliary drive power transmission gear train are arranged parallel to each other between the first drive gear and the bearing.

3. The starter unit for an engine as disclosed in claim 2, wherein the one way starter clutch is provided with a clutch inner input with drive force from the starter motor, and a clutch outer fitted to the crankshaft incapable of relative rotation, and having an inner boss section supported on the clutch inner capable of relative rotation, and the inner boss section is fitted between the first drive gear and the second drive gear.

4. The starter unit for an engine as disclosed in claim 2, wherein the first drive gear, the inner boss section of the clutch outer and the second drive gear are in mutual contact and fitted on the crankshaft incapable of relative rotation, a tube section contacting an outer surface of an inner race of the bearing arranged further inwards in an axial inner direction than the second drive gear is integrally provided in an extended manner on the second drive gear, and a bolt having a spread diameter head contacting and engaging with an outer end of the first drive gear is coaxially screwed into one end of the crankshaft.

5. The starter unit for an engine as disclosed in claim 3, wherein the first drive gear, the inner boss section of the clutch outer and the second drive gear are in mutual contact and fitted on the crankshaft incapable of relative rotation, a tube section contacting an outer surface of an inner race of the bearing arranged further inwards in an axial inner direction than the second drive gear is integrally provided in an extended manner on the second drive gear, and a bolt having a spread diameter head contacting and engaging with an outer end of the first drive gear is coaxially screwed into one end of the crankshaft.

* * * * *